US009217576B2

(12) United States Patent
Ikeno et al.

(10) Patent No.: US 9,217,576 B2
(45) Date of Patent: Dec. 22, 2015

(54) BACKFLOW PREVENTION APPARATUS OF CLEAN ROOM

(75) Inventors: Naoya Ikeno, Kyoto (JP); Yousuke Okui, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 924 days.

(21) Appl. No.: 13/406,964

(22) Filed: Feb. 28, 2012

(65) Prior Publication Data

US 2012/0295530 A1 Nov. 22, 2012

(30) Foreign Application Priority Data

May 18, 2011 (JP) ..... 2011-111498

(51) Int. Cl.
*F24F 9/00* (2006.01)
*F24F 3/16* (2006.01)
*F24F 11/00* (2006.01)

(52) U.S. Cl.
CPC ..... *F24F 3/161* (2013.01); *F24F 2011/0041* (2013.01); *F24F 2221/40* (2013.01)

(58) Field of Classification Search
None
See application file for complete search history.

(56) References Cited

U.S. PATENT DOCUMENTS 760,182 A * 5/1904 Chapman et al. ..... 454/333
1,955,374 A * 4/1934 Cobb et al. ..... 34/191
2,029,153 A * 1/1936 Burner ..... 62/91
2,061,535 A * 11/1936 Davies ..... 454/206
2,120,605 A * 6/1938 Ford et al. ..... 454/36
2,528,130 A * 10/1950 Frisk et al. ..... 454/305
2,561,592 A * 7/1951 Palmer ..... 261/24
2,616,617 A * 11/1952 Hill ..... 415/121.3
2,651,987 A * 9/1953 Buttner ..... 454/342
2,901,961 A * 9/1959 Cotts ..... 49/77.1
2,992,604 A * 7/1961 Trotman et al. ..... 454/120
3,252,400 A * 5/1966 Madl, Jr. ..... 454/187
3,318,076 A * 5/1967 Baker ..... 55/350.1
3,358,577 A * 12/1967 Thomson ..... 454/320
3,701,311 A * 10/1972 McLarty ..... 454/319

(Continued)

FOREIGN PATENT DOCUMENTS

CN 101559388 10/2009
EP 0 768 498 4/1997

(Continued)

OTHER PUBLICATIONS

Chinese Search Report (SR) issued Feb. 8, 2014 in corresponding Chinese Patent Application No. 201210044273.7, together with English translation thereof.

(Continued)

*Primary Examiner* — Gregory Huson
*Assistant Examiner* — Martha Becton
(74) *Attorney, Agent, or Firm* — Wenderoth, Lind & Ponack, L.L.P.

(57) ABSTRACT

The present invention is to provide a backflow prevention apparatus of a clean room for solving a negative pressure point in the clean room so as to prevent a backflow from underfloor of the clean room. An intake port sucks the air of an underfloor chamber, a fan supplies the air to an upper part in the apparatus, and a blowoff port is installed on a side surface of an upper-floor part of the apparatus for supplying the air into the clean room. By supplying the air of the underfloor chamber into the clean room, the backflow from the underfloor chamber into the clean room is prevented.

4 Claims, 8 Drawing Sheets

(56) References Cited

U.S. PATENT DOCUMENTS

| | | | | | |
|---|---|---|---|---|---|
| 3,923,482 | A * | 12/1975 | Knab et al. | 55/412 |
| 4,024,803 | A * | 5/1977 | Linecker | 454/185 |
| 4,253,384 | A * | 3/1981 | Schmidt et al. | 454/284 |
| 4,522,255 | A * | 6/1985 | Baker | 165/48.1 |
| 4,526,227 | A * | 7/1985 | Baker | 165/124 |
| 4,628,801 | A * | 12/1986 | Hashimoto | 454/285 |
| 4,676,146 | A * | 6/1987 | Takahashi et al. | 454/256 |
| 4,775,001 | A * | 10/1988 | Ward et al. | 165/214 |
| 5,063,833 | A * | 11/1991 | Hara et al. | 454/152 |
| 5,086,692 | A * | 2/1992 | Welch et al. | 454/187 |
| 5,144,781 | A * | 9/1992 | Fitzner | 52/263 |
| 5,238,452 | A * | 8/1993 | Levy et al. | 454/306 |
| 5,318,474 | A * | 6/1994 | Klassen et al. | 454/296 |
| 5,338,252 | A * | 8/1994 | Bowler et al. | 454/155 |
| 5,356,335 | A * | 10/1994 | Matsui et al. | 454/52 |
| 5,518,451 | A * | 5/1996 | Renz et al. | 454/187 |
| 5,582,544 | A * | 12/1996 | Ely | 454/306 |
| 5,586,935 | A * | 12/1996 | Kotoh et al. | 454/320 |
| 5,634,975 | A * | 6/1997 | Josefsson | 118/326 |
| 5,660,586 | A * | 8/1997 | Chiu et al. | 454/200 |
| 5,690,550 | A * | 11/1997 | Mikowski | 454/155 |
| 5,792,226 | A * | 8/1998 | Lee et al. | 55/385.2 |
| 5,814,116 | A | 9/1998 | Schneider et al. | |
| 5,910,045 | A * | 6/1999 | Aoki et al. | 454/186 |
| 6,036,757 | A * | 3/2000 | Gatchell et al. | 96/424 |
| 6,131,403 | A * | 10/2000 | Ji | 62/186 |
| 6,139,421 | A * | 10/2000 | Tong et al. | 454/52 |
| 6,146,264 | A * | 11/2000 | Tong et al. | 454/52 |
| 6,192,922 | B1 * | 2/2001 | MacGibbon et al. | 137/486 |
| 6,196,914 | B1 * | 3/2001 | Lyu | 454/153 |
| 6,226,568 | B1 * | 5/2001 | Tong et al. | 700/277 |
| 6,280,507 | B1 * | 8/2001 | Walker | 95/273 |
| 6,283,380 | B1 * | 9/2001 | Nakanishi et al. | 236/49.3 |
| 6,315,657 | B1 * | 11/2001 | Schmidt | 454/320 |
| 6,318,113 | B1 * | 11/2001 | Levy et al. | 62/426 |
| 6,338,677 | B1 * | 1/2002 | White | 454/335 |
| 6,361,590 | B1 * | 3/2002 | Gilbert et al. | 96/384 |
| 6,582,192 | B2 * | 6/2003 | Tseng | 415/211.1 |
| 6,616,524 | B2 * | 9/2003 | Storck et al. | 454/184 |
| 6,644,092 | B1 * | 11/2003 | Oppel | 73/1.61 |
| 6,685,555 | B1 * | 2/2004 | Davis et al. | 454/155 |
| 6,736,016 | B1 * | 5/2004 | Tong et al. | 73/861.52 |
| 6,755,734 | B2 * | 6/2004 | Yokoyama et al. | 454/187 |
| 6,829,522 | B1 * | 12/2004 | Filev et al. | 700/282 |
| 6,929,684 | B2 * | 8/2005 | Chang et al. | 96/226 |
| 7,001,262 | B2 * | 2/2006 | Tong | 454/52 |
| 7,309,386 | B2 * | 12/2007 | Wu et al. | 96/70 |
| 7,366,632 | B2 * | 4/2008 | Hamann et al. | 702/130 |
| 7,390,352 | B2 * | 6/2008 | Leng et al. | 96/39 |
| 7,789,921 | B2 * | 9/2010 | Thurin et al. | 55/282 |
| 8,154,870 | B1 * | 4/2012 | Czamara et al. | 361/694 |
| 8,382,565 | B2 * | 2/2013 | Dawson et al. | 454/239 |
| 8,812,275 | B2 * | 8/2014 | Archibald et al. | 703/2 |
| 8,867,204 | B1 * | 10/2014 | Gardner | 361/679.46 |
| 8,939,824 | B1 * | 1/2015 | Bash et al. | 454/184 |
| 2004/0198214 | A1 * | 10/2004 | Karidis et al. | 454/186 |
| 2004/0237572 | A1 * | 12/2004 | Lee et al. | 62/419 |
| 2005/0187664 | A1 * | 8/2005 | Bash et al. | 700/276 |
| 2006/0199508 | A1 * | 9/2006 | Nair et al. | 454/237 |
| 2006/0223433 | A1 * | 10/2006 | Matsuzawa et al. | 454/184 |
| 2007/0021050 | A1 * | 1/2007 | Kennedy | 454/187 |
| 2008/0051024 | A1 * | 2/2008 | Caliendo et al. | 454/369 |
| 2009/0149124 | A1 * | 6/2009 | Stevenson et al. | 454/358 |
| 2010/0041327 | A1 * | 2/2010 | Desler | 454/184 |
| 2010/0281895 | A1 * | 11/2010 | Okamoto et al. | 62/160 |
| 2010/0311317 | A1 * | 12/2010 | McReynolds et al. | 454/256 |
| 2011/0028081 | A1 * | 2/2011 | Hopkins et al. | 454/259 |
| 2011/0036540 | A1 * | 2/2011 | Ahladas et al. | 165/53 |
| 2011/0237174 | A1 * | 9/2011 | Felisi et al. | 454/184 |
| 2012/0006038 | A1 * | 1/2012 | Sharma et al. | 62/97 |
| 2012/0035781 | A1 * | 2/2012 | Archibald et al. | 700/300 |
| 2012/0052789 | A1 * | 3/2012 | Levy et al. | 454/290 |

FOREIGN PATENT DOCUMENTS

| | | |
|---|---|---|
| JP | 62-9135 | 1/1987 |
| JP | 2004-218919 | 8/2004 |
| JP | 2009-186136 | 8/2009 |
| JP | 2009-186137 | 8/2009 |

OTHER PUBLICATIONS

Chinese Office Action (OA) issued Feb. 8, 2014 in corresponding Chinese Patent Application No. 201210044273.7, together with English translation thereof.

Japanese Office Action (OA) issued Apr. 16, 2013 in Japanese Application No. 2011-111498 (with English translation).

* cited by examiner

BACKFLOW PREVENTION APPARATUS OF CLEAN ROOM

BACKGROUND OF THE INVENTION

The present invention relates to a backflow prevention apparatus of a clean room applied to a dust-free room or a germ-free room of a semiconductor manufacturing plant, a FPD (Flat Panel Display) manufacturing plant, a precision machine plant, a pharmaceutical manufacturing plant, or the like.

Conventionally, there is a total down-flow system as shown in FIG. 6 as a system for realizing a clean room with a high cleaning level. With this system, the air in a ceiling chamber 264 flows into a clean room 262 from air intake ports of fan filter units (hereinafter, FFUs) 217 installed in a ceiling of the clean room 262, pressure thereof is boosted by an internal air blower, dust is removed by a high-performance filter, and then the clean air flows in the vertically downward direction in the clean room 262. Next, a circulation flow is formed in such a manner that the air passes through a grating floor 261 of the clean room 262, flows into an underfloor chamber 263, and returns to the ceiling chamber 264 via a return flow path 266. By such a circulation, the dust of the same air is removed several times by the high-performance filter. Thus, after a certain fixed time elapses after operation of the clean room 262 is started, a high cleaning level is maintained in the clean room 262.

In a semiconductor manufacturing plant or a FPD manufacturing plant, in accordance with high integration of devices, environmental conditions such as a cleaning level, a temperature, or humidity are required to be controlled at higher level. Further, due to tougher price competition of a semiconductor or a FPD in recent years, construction cost of the clean room, that is, initial cost, and running cost of the clean room itself are required to be reduced. Thus, there are attempts to reduce the installment number of clean air blowoff devices such the FFUs.

In the clean room 262, in general, a number of manufacturing devices 265 provided only with FFUs or fans are installed, and the air taken in by the manufacturing devices is often exhausted to the external air or directly exhausted to the underfloor chamber 263, so that an air amount in the clean room 262 is decreased. Therefore, in a case where the installment number of the clean air blowoff devices such as the FFUs 217 installed in the ceiling 264 of the clean room is reduced, a point where pressure in the clean room 262 is lower than pressure of the underfloor chamber 263 is generated, so that a backflow from the underfloor chamber 263 into the clean room 262 is generated.

When the backflow from the underfloor chamber 263 into the clean room 262 is generated, an air flow in the vertically downward direction in the clean room 262 is largely disturbed so as to cause deterioration of the cleaning level. Further, in general, a pump, a chemicals tank, pipes, and the like are arranged in the underfloor chamber 263. Thus, grit and dust accumulated and attached on surfaces of these auxiliary facilities fly together with the backflow air and flow into the clean room 262, so that contamination remarkably progresses. Such a contamination problem due to the backflow is an important problem that is more unavoidable as saving facilities and energy of the clean room 262 is more facilitated to come close to a limit design.

There is a conventional technique that a sensor for detecting the flow direction or velocity of the air is arranged at a position in the vicinity of a floor, and a control means for adjusting a flow rate of the clean air blown off from the FFUs 217 installed in the ceiling of the clean room in accordance with a detected value of the sensor is provided.

This control means is a differential pressure gauge for indirectly detecting the flow direction or the velocity of the air by detecting differential pressure of upper and lower spaces taking the floor as a border by the sensor installed in the vicinity of the floor of the clean room. The control means adjusts the flow rate of the clean air blown off from the FFUs 217 installed in the ceiling 264 of the clean room in such a manner that the differential pressure detected by the differential pressure gauge is within a fixed range, so that an effect of reducing the installment number of the clean air blowoff devices such the FFUs 217 installed in the ceiling 264 of the clean room without generating the backflow from the underfloor chamber is clearly described (for example, refer to Japanese Unexamined Patent Publication No. 2004-218919).

SUMMARY OF THE INVENTION

However, with the above conventional configuration, although the problem of the backflow from the underfloor chamber into the clean room can be suppressed, the following problem still remains. That is, the backflow is generated due to equipment or a device accompanied by exhaust, and especially due to shortage of the air in the clean room. The FFUs installed in the ceiling are placed at positions distant from a point where the air is in short in the clean room. Thus, the air is spread and there is a need for supplying a flow rate which is much higher than an actual shortage flow rate in the clean room from the FFUs. Therefore, the flow rate of the FFUs installed in the ceiling cannot be reduced, and as a result, energy cost is increased to a large extent.

The present invention is in consideration with the above conventional problem, and an object thereof is to provide a backflow prevention apparatus of a clean room capable of solving a negative pressure point in the clean room so as to prevent a backflow from underfloor of the clean room.

In order to achieve the above object, the present invention is formed as follows.

According to an aspect of the present invention, there is provided a backflow prevention apparatus of a clean room in which a flow of clean air blown off from a ceiling surface flows in down-flow toward an underfloor chamber partitioned by an air-permeable floor, comprising:

a casing having an intake section having an intake port that suctions air of the underfloor chamber of the clean room and a blowoff section having a blowoff port that blows off the air into the clean room;

a fan that suctions the air of the underfloor chamber from the intake port and blows off the air from the blowoff port into the clean room;

plate shape blowoff angle adjusting fins that adjusts a direction of an air flow blown off from the blowoff port in a height direction;

plate shape radial air blowing fins extending in a radial manner from an apparatus center at the blowoff port, the radial air blowing fins being parallel to each other in the height direction; and a control device that controls drive of the fan so as to supply a shortage flow rate in the clean room from the underfloor chamber into the clean room.

As described above, according to the backflow prevention apparatus of the clean room of the present invention, the shortage flow rate in the clean room can be supplied and supplemented from the underfloor chamber into the clean room. Thus, without generating the backflow from the underfloor chamber, an energy-saving clean design in which the number of circulation is reduced can be provided.

BRIEF DESCRIPTION OF THE DRAWINGS

These and other aspects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1A:
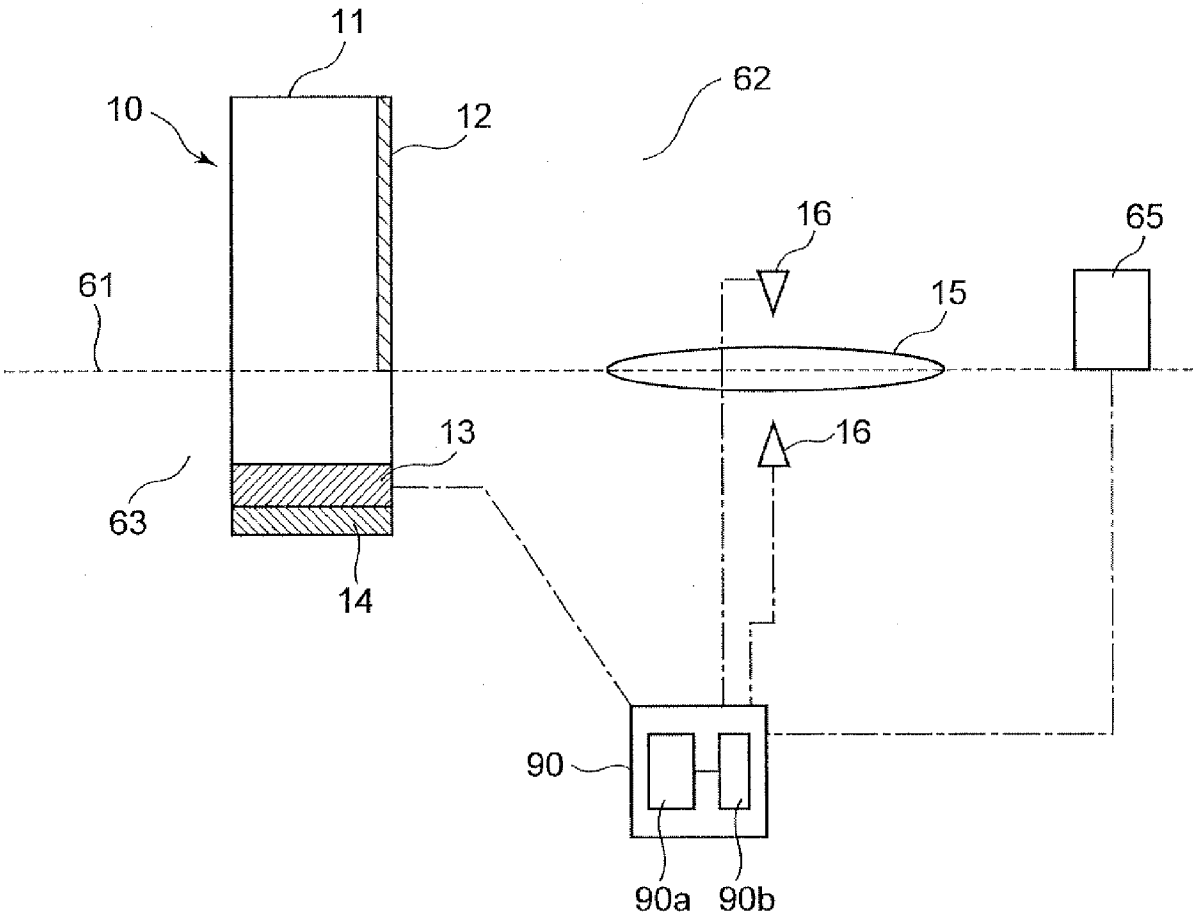
FIG. 1A is a schematically vertically sectional view of a backflow prevention apparatus of a clean room in an embodiment of the present invention.

Before the description of the present invention proceeds, it is to be noted that like parts are designated by like reference numerals throughout the accompanying drawings.

Hereinafter, an embodiment of the present invention will be described with reference to the drawings.

FIG. 1A is a plan view showing a schematic configuration of a backflow prevention apparatus 10 of a clean room in one embodiment of the present invention. In this clean room 62, a flow of the clean air blown off from a ceiling surface flows in down-flow toward an underfloor chamber 63 partitioned by an air-permeable floor 61.

The backflow prevention apparatus 10 of this clean room is formed by a casing 11 of the backflow prevention apparatus 10, a blowoff port 12 installed on a side surface of the casing 11 at a position on the upper side of the grating floor 61 of the clean room 62, a FFU (fan filter unit) 13 installed at a position away from the blowoff port 12 on the lower side of the grating floor 61 in the casing 11, and an intake port 14 arranged on a bottom surface of the casing 11 on the lower side of the FFU 13.

The blowoff port 12 of the backflow prevention apparatus 10 is preferably placed at a point not really high from a floor surface of the grating floor 61. In a case where a position of the blowoff port 12 is higher than the floor surface of the grating floor 61, the blowoff port becomes distant from the floor surface of the grating floor 61 on which a backflow is generated in the clean room 62. Thus, the blown-off air is spread, and a backflow prevention effect described later is reduced. As one example, as shown in FIG. 1A, the blowoff port 12 is arranged on the side surface of the casing 11 between the floor surface of the grating floor 61 and a predetermined height.

It should be noted that in a case where a filter is provided in the blowoff port 12 as another configuration of the backflow prevention apparatus 10, the FFU 13 may be formed only by a fan (air blower) without a filter. By installing a FFU in the blowoff port 12, no FFU 13 is arranged but only the intake port 14 may be arranged on the lower side of the casing 11 in the backflow prevention apparatus 10.

An optimal filter of the FFU 13 is adopted in accordance with a cleaning level required for the clean room 62. A fan capable of satisfying a required blowoff amount is selected and adopted.

The blowoff port 12 preferably has a structure that the air blown off from the blowoff port 12 is in the horizontal direction or obliquely downward. In a case where the air is blown off upward or obliquely upward from the blowoff port 12, an upstream flow taking in the surrounding air is generated, and accordingly, there is a possibility that the air of the underfloor chamber 63 is also taken up. Therefore, there is a possibility that the backflow is induced from the underfloor chamber 63 of the clean room 62.

The air of the underfloor chamber 63 is taken in from the intake port 14 installed in a lower part (bottom part) of the backflow prevention apparatus 10. A cleaning level of the air is increased to a cleaning level required in the clean room 62 by the FFU 13. The air is fed to the blowoff port 12 toward an upper part in the backflow prevention apparatus 10 by a fan of the FFU 13, and blown off into the clean room 62 from the blowoff port 12 whose height is positioned on the upper side of the grating floor 61 of the clean room 62, so that the shortage air in the clean room 62 is supplied.

As an operation method of the fan of the FFU 13, by operating the fan only when the backflow is generated from the underfloor chamber 63 of the clean room 62 and stopping the operation of the fan in a case where the backflow is not generated, an operation method of saving energy of the backflow prevention apparatus 10 itself can be used. In order to realize this operation, differential pressure gauges 16 for detecting differential pressure of upper and lower spaces taking the grating floor 61 as a border are installed. Detected values of the differential pressure gauges 16 are inputted to a control device 90, and the control device 90 controls to turn ON/OFF the fan of the FFU 13 based on the detected values of the differential pressure gauges 16 for realizing the above operation. As one example, the following control can be thought: when the control device 90 determines that the detected values of the differential pressure gauges 16 exceed a threshold value, the fan of the FFU 13 is turned ON so that the backflow is not generated, and when the control device 90 determines that the detected values of the differential pressure gauges 16 are a threshold value or less, the fan of the FFU 13 is turned OFF so that the backflow is not generated.

The backflow is generated because a facility 65 in the clean room 62 is exhausting. Thus, information on an operation situation of the facility 65 is inputted to the control device 90, and in accordance with the operation situation of the facility 65, the fan of the FFU 13 can be controlled and turned ON/OFF under the control of the control device 90.

A structure and a blowoff method of the backflow prevention apparatus 10 and the blowoff port 12 will be described with reference to FIGS. 2A and 2B.

Figure 2A:
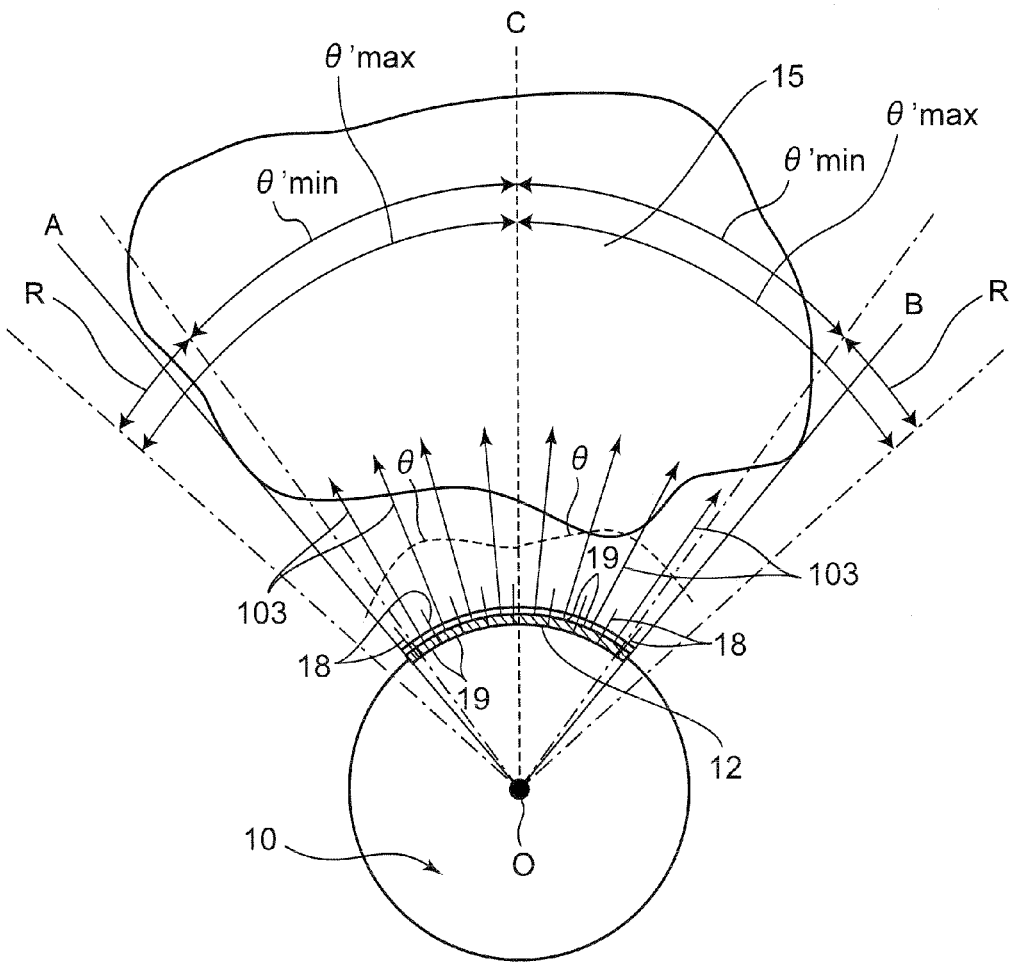
FIG. 2A is a plan view showing how the air is blown off from a blowoff port of the backflow prevention apparatus of the clean room in the embodiment of the present invention.

As shown in FIGS. 2A and 25, the blowoff port 12 is installed on the side surface of the backflow prevention apparatus 10 at a part positioned on the upper side of the grating floor 61. Length in the height direction of the blowoff port 12 is up to a position lower than an upper surface of the backflow prevention apparatus 10. It should be noted that a position of an uppermost part of the blowoff port 12 is preferably 2 m or less from the grating floor 61. In a case where blowoff from the blowoff port 12 of the backflow prevention apparatus 10 is too high relative to the grating floor 61, the air blown off from the blowoff port 12 is spread before reaching the grating floor 61. Thus, a backflow prevention effect is weakened. Therefore, in order to prevent the backflow, a more blowoff flow rate is required.

Figure 2B:
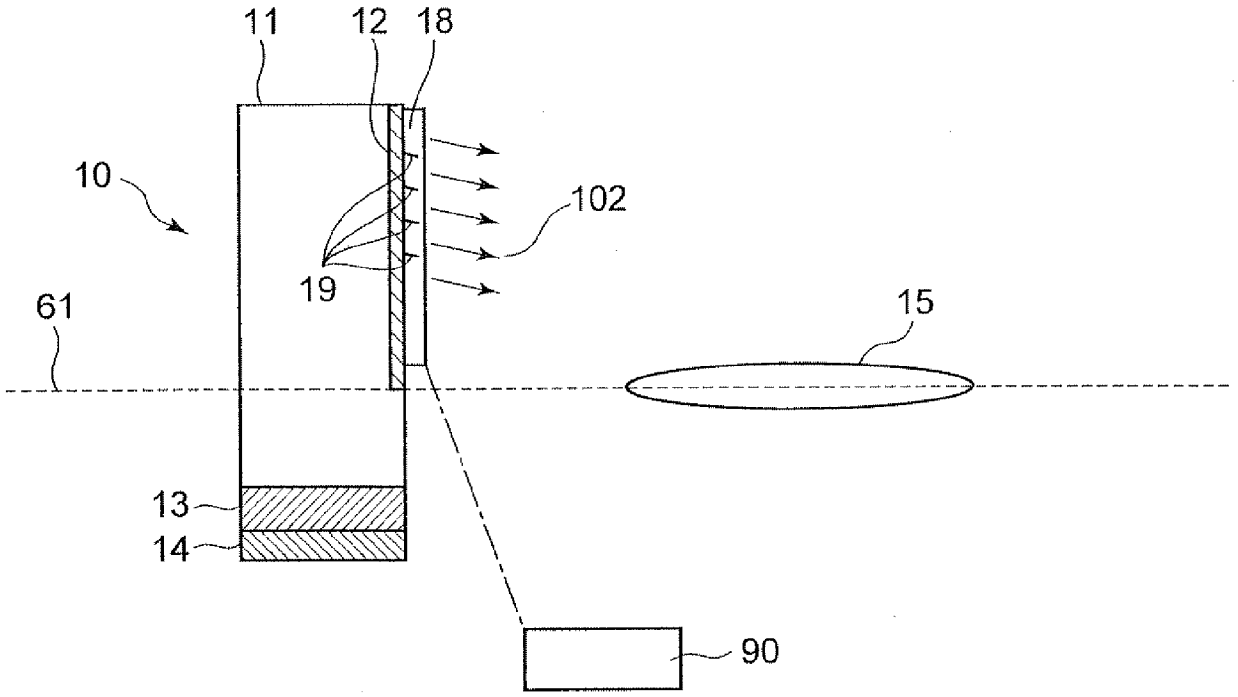
FIG. 2B is a vertically sectional view showing how the air is blown off from the blowoff port of the backflow prevention apparatus of the clean room in the embodiment of the present invention.

As shown in FIGS. 2A and 2B, radial air blowing fins 18 are installed in a radial manner in the blowoff port 12. In a case where the backflow prevention apparatus 10 has a columnar shape, the blowoff port 12 and the radial air blowing fins 18 are installed within a range formed by an axis center of the backflow prevention apparatus and straight lines A, B extending in a radial manner from a surface of the backflow prevention apparatus 10. The radial air blowing fins are flat plates parallel to each other in the height direction. The radial air blowing fins 18 are installed in such a way, and by driving the radial air blowing fins 18 under the control of the control device 90, the air is blown off from the blowoff port 12 in the radial direction from the center of the backflow prevention apparatus 10. The reference numeral 103 denotes streamlines indicating the blowoff direction from the blowoff port 12 in the width direction.

As shown in FIG. 2A, the center of the backflow prevention apparatus 10 is O, and a straight line connecting the apparatus center O and a left end of a range of a backflow 15 when the backflow 15 is generated is A. A straight line connecting the apparatus center O and a right end of the range of the backflow 15 is B. A bisector of ∠AOB is C. At this time, ∠AOC=∠BOC=θ. The blowoff port 12 is installed on the surface of the backflow prevention apparatus 10 within the range of the straight line A and the straight line B.

Due to such a structure, width of the blowoff port 12 is determined by the angle θ.

Plate shape blowoff angle adjusting fins 19 for adjusting a blowoff angle in the height direction are similarly installed in the blowoff port 12.

An angle of the blowoff angle adjusting fins 19 is adjusted only to the horizontal direction and the downward direction. This is because in a case where the air blown off from the blowoff port 12 is upward, an upstream flow taking in the surrounding air is generated, and the backflow from the underfloor chamber 63 is caused. With such a configuration, the air is blown off from the blowoff port 12 by the blowoff angle adjusting fins 19 by an angle toward the lower side of the horizontal direction. The reference numeral 102 denotes streamlines indicating the blowoff direction from the blowoff port 12 in the height direction.

A shortage flow rate in the clean room 62 is equal to a backflow flow rate. Thus, not the backflow flow rate from the grating floor 61 of the clean room 62 but the shortage flow rate in the clean room 62 is calculated by an arithmetic portion 90*b* provided in the control device 90 separately from a control main body portion 90*a*. Detected information from the differential pressure gauges 16 and the like and information from the facility 65 and the like are inputted to the control main body portion 90*a*. When the detected information from the differential pressure gauges 16 and the like are inputted from the control main body portion 90*a* to the arithmetic portion 90*b*, the arithmetic portion 90*b* performs predetermined arithmetic operation. Based on an arithmetic result of the arithmetic portion 90*b*, the control main body portion 90*a* controls drive of the fan 13.

An area in which the backflow 15 is generated is A ($m^2$), and a flow velocity at a point of the backflow determined from the detected information of a flow velocimeter or the differential pressure gauges 16 is Vi (m/s), and the backflow flow rate is Q. Then,

[Expression 1]

$$Q=A\times\int Vi\ dx\ dy \quad (1)$$

By using this expression, the arithmetic portion 90*b* can calculate the backflow flow rate Q. Here, x, y are x-coordinate and y-coordinate of orthogonal coordinates in a plane of FIG. 2A.

This calculated value is an actual shortage flow rate in the clean room 62.

The backflow area, the flow velocity thereof, or the differential pressure of the upper and lower spaces of the grating floor 61 can be grasped by measuring at the respective points by one or a plurality or flow velocimeters or differential pressure gauges 16.

Figure 1B:
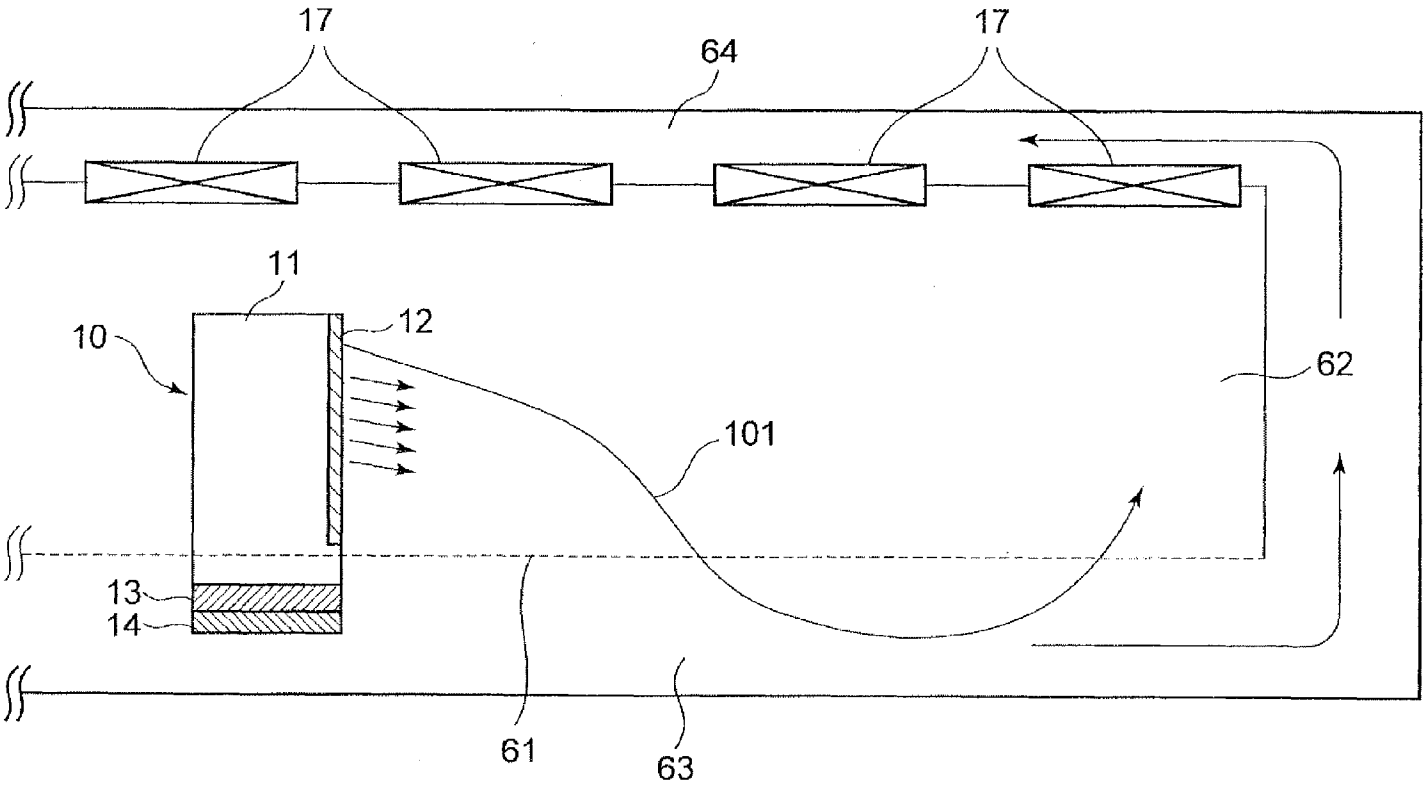
FIG. 1B is a view of an air flow in the clean room in the embodiment of the present invention.

A blowoff flow rate Qout from the blowoff port 12 of the backflow prevention apparatus 10 is required to be controlled to an appropriate amount. In a case where the blowoff flow rate Qout is too little relative to the shortage flow rate in the clean room 62, backflow prevention serving as the original object cannot be achieved, and the backflow 15 from the underfloor chamber 63 cannot be completely suppressed. In a case where the blowoff flow rate Qout is excessive relative to the appropriate amount, as shown by an arrow 101 of FIG. 1B, in a process that the extra air flows and enters the underfloor chamber 63 of the clean room 62 and then circulates the underfloor chamber 63 of the clean room 62, a point where the backflow 15 is generated is produced. Since the extra air flows into the underfloor chamber 63 of the clean room 62, a more flow rate than usual flows in the underfloor chamber 63 of the clean room 62 as a result. Thus, a point where a pressure balance is lost between pressure in the underfloor chamber 63 and chamber pressure in the clean room 62 is generated, so that the backflow 15 is generated from the underfloor chamber 63.

At this time, the appropriate amount of the blowoff flow rate Qout preferably maintains a relationship of

[Expression 2]

$$1.20\times Q\leq Qout\leq 3.47\times Q \quad (2).$$

Figure 3:
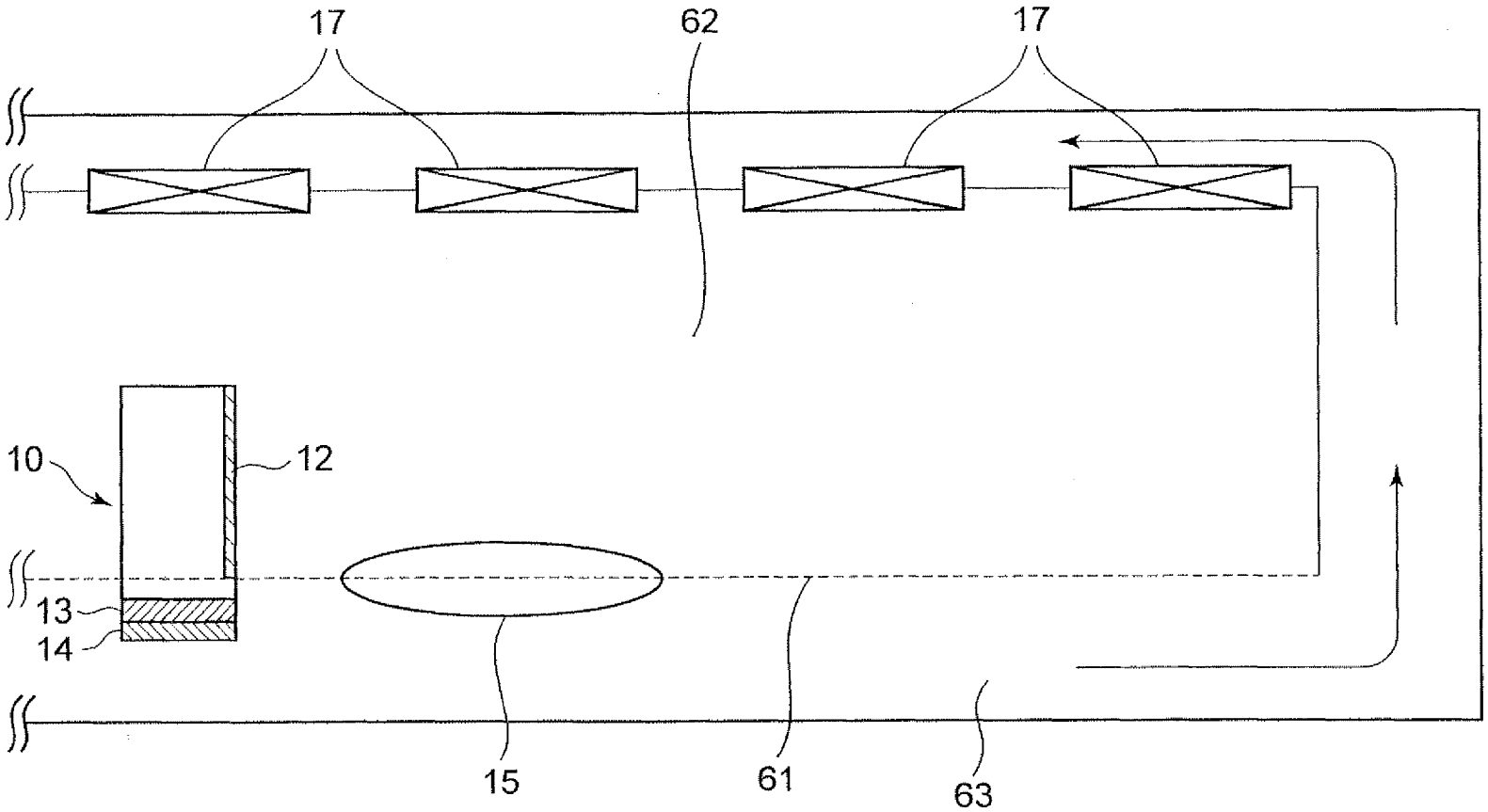
FIG. 3 is a view of an analysis model in which the backflow prevention apparatus of the clean room in working example 1 according to the embodiment of the present invention is installed.

This relational expression was obtained by a result of thermo-fluid analysis of a relationship between an optimal value of the blowoff flow rate Qout of the backflow prevention apparatus 10 installed in the clean room 62 and the area of the backflow from the floor 61 in the clean room 62 in a configuration of FIG. 3 by using thermo-fluid analysis software (STREAM manufactured by Software Cradle Co., Ltd.).

Figure 4:
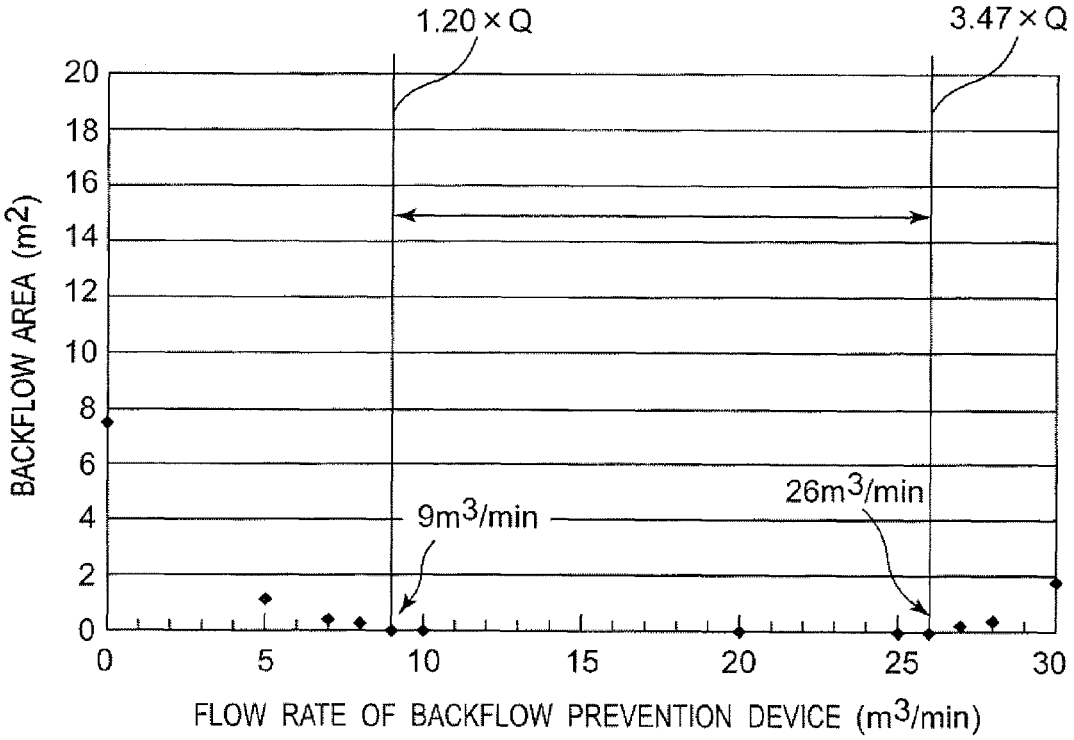
FIG. 4 is a graph showing a result of analysis of a relationship between an apparatus blowoff flow rate and a backflow area of the backflow prevention apparatus of the clean room in the embodiment of the present invention.

The backflow prevention apparatus 10 is installed in the clean room 62 in which the backflow 15 of 7.49 $m^3$/min is generated in FIG. 3, and FIG. 4 shows the result of the thermo-fluid analysis of the optimal flow rate of the blowoff flow rate Qout from the backflow prevention apparatus 10. In FIG. 4, the vertical axis indicates the area ($m^2$) in which the backflow 15 is generated, and the horizontal axis indicates the blowoff flow rate ($m^3$/min) from the backflow prevention apparatus 10.

As a result of the analysis, by making the blowoff flow rate 9 $m^3$/min or more, the backflow 15 from the grating floor 61 was capable of being prevented. Conversely, in a case where the blowoff flow rate was 26 $m^3$/min or more, the backflow 15 was newly generated from the underfloor chamber 63. That is, it was found that the blowoff flow rate is required to be a flow rate which is 1.20 times or more and 3.47 times or less more than the original backflow flow rate (7.49 $m^3$/min). As a result, the above expression (2) was obtained.

The width direction of the blowoff from the blowoff port 12 of the backflow prevention apparatus 10 will be described with reference to FIG. 2A.

As shown in FIG. 2A, as described above, the angle which is a half of the range of the backflow 15 from the apparatus center O is θ, and the angle of actually blowing from the blowoff port 12 is θ'. In a case of blowing in a narrower area than the backflow range (the range of the backflow 15), θ'<θ. In a case of blowing in a wider area than the backflow range (the range of the backflow 15), θ'>θ.

With such a configuration, the width of the blowoff of the blowoff port 12 and the range capable of covering the backflow 15 (the range of the backflow 15) are determined by the angle θ'. Therefore, when the angles are θ'=θ, the width of the air blown off from the blowoff port 12 of the backflow prevention apparatus 10 just matches with the backflow range (the range of the backflow 15).

Due to such a configuration, when a case where the backflow prevention apparatus 10 is installed at a distance close to the backflow 15 is compared with a case where the backflow prevention apparatus is installed at a distance distant from the backflow 15, it is found that the angle θ is increased in the backflow prevention apparatus 10 being installed at a distance close to the backflow 15, and thus, the blowoff width of the blowoff port 12 is increased. However, the blowoff flow rate of the backflow prevention apparatus 10 is the same between a case where the backflow prevention apparatus 10 is installed at a close place to the backflow 15 and a case where the backflow prevention apparatus 10 is installed at a distant place from the backflow 15. Thus, the flow velocity is necessarily more slowed down in a case where the backflow prevention apparatus 10 is installed at a close place (when the blowoff flow velocity is V and the blowoff area is D, the blowoff flow velocity V is defined by a relational expression V=Q/D, and since Q is constant, the flow velocity V is in an inversely proportional relationship with the blowoff area D).

The blowoff width from the blowoff port 12 of the backflow prevention apparatus 10 is required to be optimal width. The blowoff width can be defined by the angle θ' as described above. Therefore, from the relational expression θ'/θ, an optimal blowoff angle preferably maintains a relationship of

[Expression 3]

$$0.9 \leq (\theta'/\theta) \leq 1.2 \quad (3)$$

This relational expression was obtained by a result of thereto-fluid analysis of a relationship between the blowoff angle θ' from the blowoff port 12 of the backflow prevention apparatus 10 and the backflow area by using the thermo-fluid analysis software (STREAM manufactured by Software Cradle Co., Ltd.). In the analysis model of this time, a value of θ defined the embodiment is 33°.

Figure 5A:
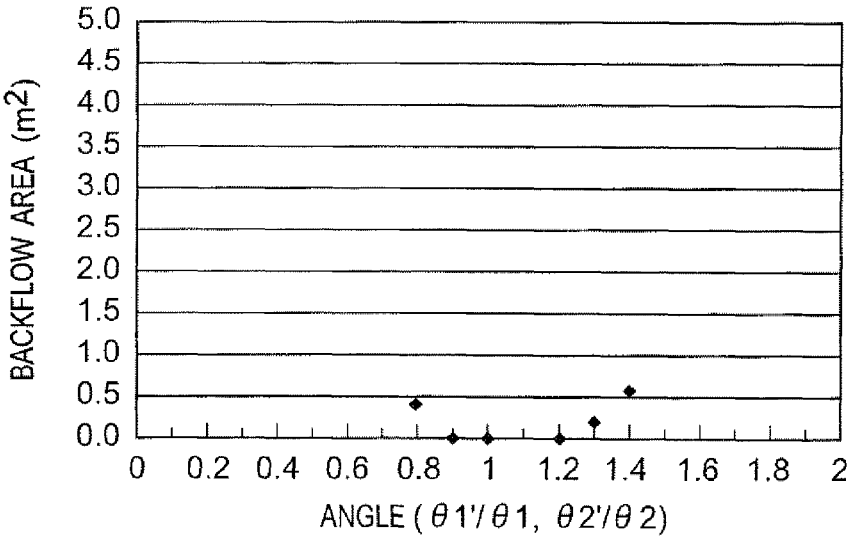
FIG. 5A is a graph showing a result of analysis of a relationship between an apparatus blowoff angle and the backflow area in a case where a flow rate is minimum in the backflow prevention apparatus of the clean room in the embodiment of the present invention.
Figure 5B:
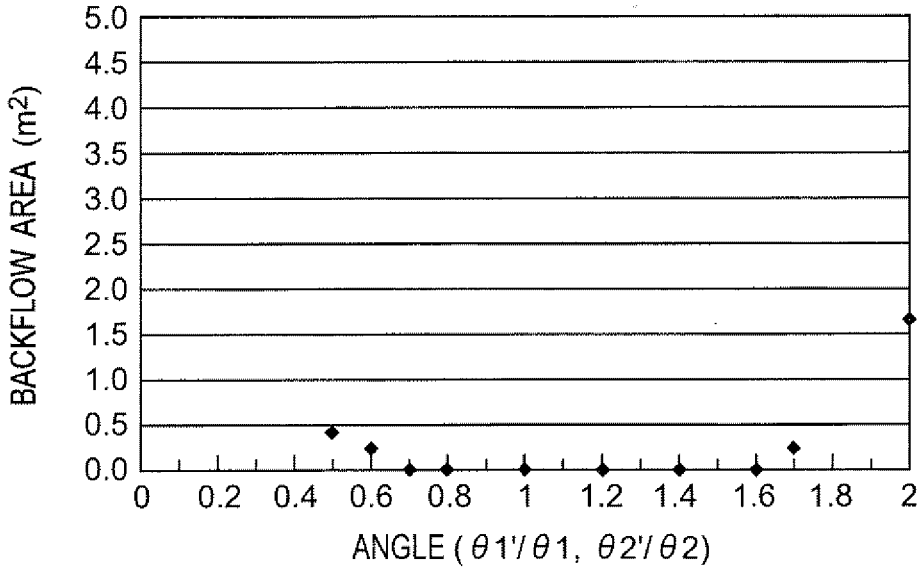
FIG. 5B is a graph showing a result of analysis of a relationship between the apparatus blowoff angle and the backflow area in a case where the flow rate is maximum in the backflow prevention apparatus of the clean room in the embodiment of the present invention.
Figure 6:
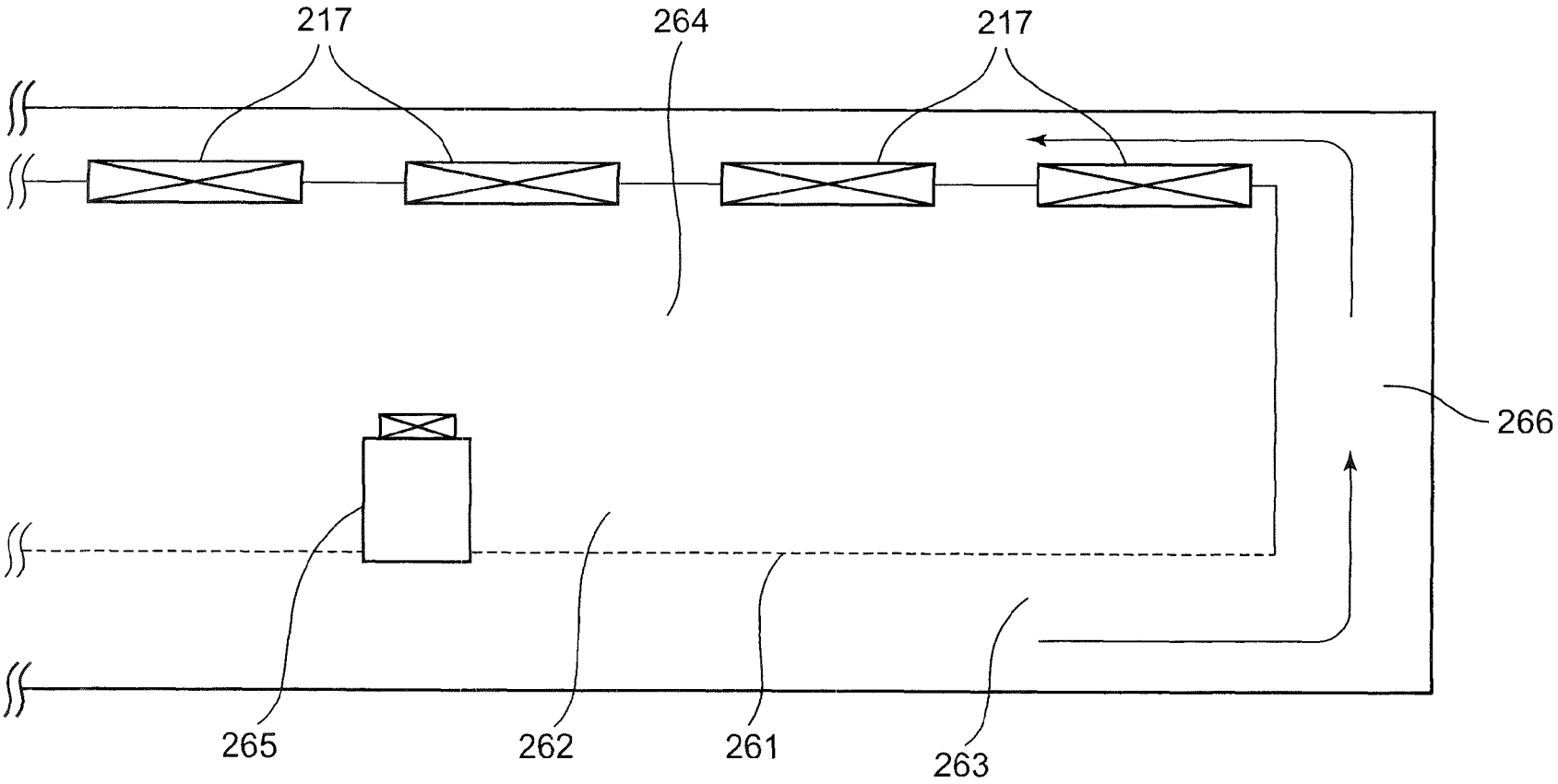
Fig.6 PRIOR ART
FIG. 6 is a schematically sectional view showing a conventional clean room in Japanese Unexamined Patent Publication No. 2004-218919.

From the result of the proper blowoff amount described above, the thermo-fluid analysis was respectively performed to Model 1 in which the flow rate from the blowoff port 12 from the backflow prevention apparatus 10 is minimum (blowoff flow rate: 9 $m^3$/min) and Model 2 in which the flow rate from the blowoff port 12 is maximum (blowoff flow rate: 26 $m^3$/min). FIGS. 5A and 5B respectively show analysis results thereof. The vertical axis indicates the backflow area ($m^2$), and the horizontal axis indicates a non-dimensional value of θ'/θ.

As a result of the analysis, in a case of Model 1 in which the blowoff flow rate is the minimum flow rate of 9 $m^3$/min, it was found that when the value of θ'/θ is 0.9 (i.e. 0.9*θ=θ' min) or more and 1.2 (i.e. 1.2*θ=θ' max) or less, the backflow can be prevented.

In a case of Model 2 in which the blowoff flow rate is the maximum flow rate of 26 $m^3$/min, it was found that when the value of θ/θ is 0.7 or more and 1.6 or less, the backflow can be prevented. The more the blowoff flow rate is, the more easily generation of the backflow is prevented. Thus, such an analysis result is obtained.

From the result of this time, it was found that the optimal value of the blowoff angle from the blowoff port 12 of the backflow prevention apparatus 10 is required to satisfy a range (R) of

[Expression 4]

$$0.9 \leq (\theta'/\theta) \leq 1.2 \quad (4)$$

which is the strictest condition of this time.

As described above, the blowoff flow rate of the backflow prevention apparatus 10 can be grasped by measuring the area and the flow velocity at the point or the differential pressure of the upper and lower spaces of the grating floor 61. However, due to an environmental change in the clean room 62 or a production situation, the blowoff flow rate might be sometimes momentarily changed. Therefore, the plurality of sensors (the flow velocimeters or the differential pressure gauges) 16 for measuring the flow velocity or the differential pressure of the upper and lower spaces of the grating floor 61 is installed in the range in which the backflow 15 is generated. The backflow area is calculated from the range of the sensors the flow velocimeters or the differential pressure gauges) 16 indicating the backflow 15, and the backflow flow rate is calculated by the arithmetic portion 90*b* from the flow velocity measured by the sensors or the flow velocity calculated from the differential pressure by the arithmetic portion 90*b*. Based on the backflow flow rate, the control device 90 controls the flow rate of the FFU 13 of the backflow prevention apparatus 10. By providing such a mechanism, the backflow area or the backflow flow velocity which is momentarily changed can be treated.

As described above, with the clean room 62 according to the embodiment, by directly supplying the shortage flow rate from the underfloor chamber 63 to a region where the air is in short in the clean room 62, FFUs 17 in the ceiling of the clean room can be further reduced, and by realizing the further energy-saving clean room 62 in comparison to the conventional example, an effect of the present invention is obtained.

It should be noted that by appropriately combining an arbitrary embodiment or modification example among the above various embodiments or modification examples, effects possessed by the embodiments and the modification examples can be obtained.

With the backflow prevention apparatus of the clean room of the present invention, the prevention of the backflow of the contaminated air from the underfloor chamber into the clean room can be realized. Thus, the present invention is useful not only for the energy-saving clean room by reduction of the number of circulation due to reduction of the FFUs of the clean room or the like but also for use of design of a general clean room accompanied by a number of apparatus exhaust.

Although the present invention has been fully described in connection with the preferred embodiments thereof with reference to the accompanying drawings, it is to be noted that various changes and modifications are apparent to those skilled the art. Such changes and modifications are to be understood as included within the scope of the present invention as defined by the appended claims unless they depart therefrom.

What is claimed is:

1. A backflow prevention apparatus of a clean room in which a flow of clean air blown off from a ceiling surface flows in down-flow toward an underfloor chamber partitioned by an air-permeable floor, comprising:

a casing having a columnar shape and having at its lower part, an intake port configured to be opened in the underfloor chamber of the clean room with the air of the underfloor chamber of the clean room being sucked through the intake port by a fan filter unit, and at its upper part, a blowoff port configured to be opened in the clean room with the blowoff port blowing off the air into the clean room;

the fan filter unit arranged in the casing, the fan filter unit being configured to suction the air of the underfloor chamber from the intake port and blow off the air from the blowoff port into the clean room;

plate shape blowoff angle adjusting fins arranged at the intake port and configured to adjust a direction of an air flow blown off from the blowoff port in a height direction;

plate shape radial air blowing fins arranged in the blowoff port and extending in a radial direction from a center on a central longitudinal axis of the columnar shape casing, the plate shape radial air blowing fin being spanning an arc defined by the intake port;

a control device that controls drive of the fan filter unit so as to supply a shortage flow rate in the clean room from the underfloor chamber into the clean room;

a flow velocity obtaining sensor that obtains a flow velocity of a backflow from the air-permeable floor into the clean room; and an arithmetic portion that calculates a flow rate Q of the backflow by multiplying an area where the backflow is generated by the obtained flow velocity; and a control main body portion that controls drive of the fan filter unit based on an arithmetic result of the arithmetic portion a blowoff flow rate Qout from the blowoff port being in a relationship of $1.20\times Q<Qout\ 3.47\times Q$ with respect to the flow rate Q of the backflow from the floor into the clean room, wherein an angle of the blowoff angle adjusting fins is adjusted in a direction in which the air flow is blown off in a horizontal direction and/or a downward direction to direct the shortage flow rate from the underfloor chamber to the area where the backflow is occurring at the air-permeable floor.

2. The backflow prevention apparatus of the clean room according to claim 1, wherein when the center on the central longitudinal axis of the columnar shape casing is O, a straight line connecting the center O and a left end of a backflow range is A, a straight line connecting the apparatus center O and a right end of the backflow range is B, a bisector of $\angle AOB$ is C, $\angle AOC=\angle BOC=\theta$, and an angle of actually blowing from the blowoff port is $\theta'$, $0.9\leq(\theta'/\theta)\leq1.2$.

3. The backflow prevention apparatus of the clean room according to claim 1, further comprising:

a differential pressure gauge that detects differential pressure of upper and lower spaces taking the air-permeable floor as a border, wherein based on the differential pressure detected by the differential pressure gauge, the control device controls the drive of the fan filter unit so as to supply the shortage flow rate in the clean room from the underfloor chamber into the clean room.

4. The backflow prevention apparatus of the clean room according to claim 1, wherein the blowoff port in the clean room is extended to a portion where a lower end of the blowoff port being located immediately above the air-permeable floor.

* * * * *